US005477018A

United States Patent [19]

Fries et al.

[11] Patent Number: 5,477,018

[45] Date of Patent: Dec. 19, 1995

[54] MOISTURE-DETECTING, SWITCHING DEVICE AND A METHOD OF FORMING THE SAME

[75] Inventors: Hjalmar Fries, Spanga; Per Hedmark, Sundbyberg, both of Sweden

[73] Assignee: ITT Flygt AB, Solna, Sweden

[21] Appl. No.: 102,454

[22] Filed: Aug. 5, 1993

[30] Foreign Application Priority Data

Sep. 28, 1992 [SE] Sweden ..... 9202783

[51] Int. Cl.[6] ..... H01H 35/00; H01H 11/00

[52] U.S. Cl. ..... 200/61.04

[58] Field of Search ..... 200/61.04–61.07, 200/61.08; 340/604, 605; 29/622

[56] References Cited

U.S. PATENT DOCUMENTS

| | | | |
|---|---|---|---|
| 3,311,721 | 3/1968 | Wright | 200/61.04 |
| 3,578,767 | 5/1971 | Lee | 200/61.04 X |
| 3,787,650 | 1/1974 | Lewis | 200/61.04 |
| 3,983,527 | 9/1976 | Ohsato et al. | 200/61.04 X |
| 4,001,531 | 1/1977 | Crockett, Sr. | 200/61.04 |
| 4,133,016 | 1/1979 | Tanguy | 200/61.07 X |
| 4,888,455 | 12/1989 | Hanson | 200/61.04 |
| 4,910,627 | 3/1990 | Mahlich | 361/42 |

FOREIGN PATENT DOCUMENTS

| | | | |
|---|---|---|---|
| 2230250 | 12/1974 | France | H01H 35/42 |
| 3321314 | 12/1984 | Germany | H01H 35/18 |
| 3712404 | 10/1988 | Germany | H01H 71/10 |

*Primary Examiner*—J. R. Scott
*Attorney, Agent, or Firm*—Menotti J. Lombardi

[57] ABSTRACT

One end of a dual-ended housing is closed off by a plug formed of a first constituent which is a water-soluble material and a second constituent which is a thermosetting resin and forms a readily-frangible structure in the plug. An electrical switch which has an actuating plunger is set, in the housing against the plug, so that the latter holds the plunger depressed/retracted. Moisture expands the water-soluble material which, in turn, destroys the plug integrity and, subsequently, the plug is so weakened that the plunger breaks through the frangible structure to actuate the switch.

10 Claims, 1 Drawing Sheet

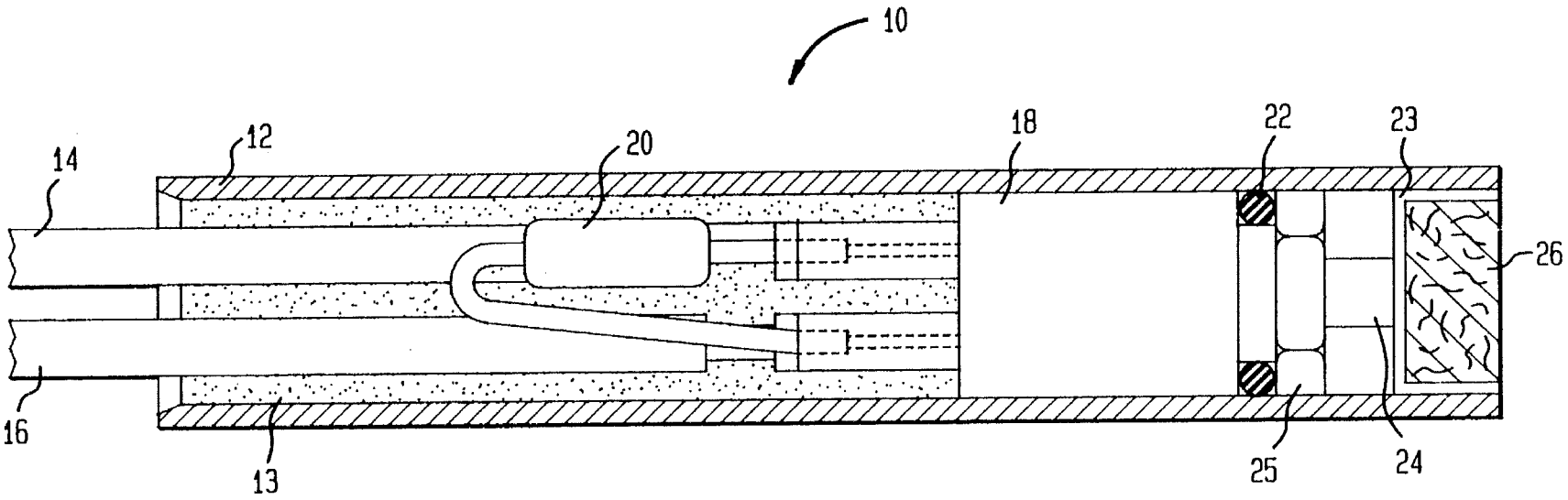
10
12
14
16
18
20
22
23
24
25
26
13

MOISTURE-DETECTING, SWITCHING DEVICE AND A METHOD OF FORMING THE SAME

BACKGROUND OF THE INVENTION

This invention pertains to moisture-detecting, switching devices, and methods of forming the same, such as are used in the stator housings of electrically-driven pumps, mixers, and the like, to detect water intrusion and either to signal such intrusion or to shut off the pumps or mixers before their motors are damaged, and in particular to an improved moisture-detecting, switching device, and method of forming the same.

Typically, electrically-driven devices, such as pimps, mixers and such, comprise three main components: driving unit (i.e., the electric motor), a sealing unit, and a hydraulic unit. The first and last units are connected via a driving shaft which transmits the torque from the rotary part of the electric motor to the impeller, propeller, or whatever is the working element of the device, in the hydraulic unit.

In order to prevent the hydraulic medium from entering the electric motor, by migration thereof along the driving shaft, there is provided one or several shaft seals between the hydraulic unit and the driving unit. A commonly used seal type is the so-called mechanical face seal which comprises a rotary seal ring, and a fixed seal ring, in which the two rings are pressed towards each other by a biasing force.

As such an aforesaid seal is arranged between a driving unit and a hydraulic unit, it will operate with the fluid, i.e. water, on one side thereof, and another medium, i.e., air in the electric motor, on the other side. There is always a certain risk that the fluid, which is pressured, will enter between the surfaces of the sealing rings and get into the motor. This is especially true when dealing with heavily polluted liquids; solid bodies in the fluid may enter between the sealing surfaces and cause such damage that a heavy leakage can ensue.

In order to provide a more secure sealing between the driving unit and the hydraulic unit, it is known to arrange a dual mechanical seal which confines an oil chamber therebetween. The seal between the oil chamber and the motor, then, will perform efficiently, as the oil, normally, will not contain any solid bodies. In addition, each of the seals is subject to a considerably lower pressure difference. Against the possibility of water entering the oil chamber, the oil is checked at prudent intervals, and is changed when and as necessary.

Such sealing arrangements notwithstanding, if water should get into the motor housing, it is important that this event be noticed immediately, before the water causes any damage to the electric windings. In such circumstances, it is desirable that the motor current be cut off, and an alarm generated, before any serious damage has occurred.

Devices for interrupting current circuits, and for generating an alarm, if a liquid has entered a given space are known.

German patent specification No. 321 314 shows a device in which electric contacts are parted by a body which is dissolved in water. A disadvantage with this arrangementis that the dissolution of the body takes place only gradually, consequently it cannot be used for strong current. U.S. Pat. No. 4,133,016 discloses a device in which a switch is controlled by a disc made of only water-soluble material, The disadvantage, here too, is that the release is too slow.

SUMMARY OF THE INVENTION

It is an object of this invention to set forth a moisture-detecting, switching device, and a method of forming the same, which resists any water intrusion, sealingly and efficiently, up to a given degree of intrusion, and then, instantly, actuates its switch, the same offering excellent reliability, while being non-expensive to manufacture and simple to install.

Particularly, it is an object of this invention to disclose a moisture-detecting, switching device, comprising a dual-ended housing having an inner surface; and an electrical switch confined within said housing; wherein said switch has an actuating plunger (a) biasingly extensible therefrom, and (b) disposed in adjacency to one end of said housing; and means fluid-sealing off said one end of said housing and restraining said plunger against extension; wherein said sealing means comprises a material formed of an admixture of a first, water-soluble constituent, and a second, non-water-soluble constituent; and said second constituent defines a structure within said sealing means which is readily frangible.

It is also an object of this invention to set forth a method of forming a moisture-detecting, switching device, comprising the steps of providing a dual-ended housing; forming a sealing means, for fluid-sealing off one end of said housing, within said one end; composing said sealing means of an admixture of a first, water-soluble constituent, and a second, non-water soluble constituent which forms a readily-frangible structure within said sealing means; confining within said housing a switch which has a biasingly extensible, actuating plunger; and setting said switch against said sealing means so that said plunger is retractably held against extension by said sealing means.

BRIEF DESCRIPTION OF THE DRAWINGS

Further objects of this invention, as well as the novel features thereof, will become more apparent by reference to the following description taken in conjunction with the accompanying figure, the latter being a longitudinal cross-section of a moisture-detecting, switching device, according to an embodiment of the invention.

DETAILED DESCRIPTION OF THE PREFERRED EMBODIMENT

As shown in the figure, the moisture detecting switching device 10, in a preferred embodiment thereof, comprises a tubular housing 12 which receives a pair of electrical conductors 14 and 16. Conductors 14 and 16 are electrically joined to a housing-confined switch 18 held in a tight fit manner. A resistor 20 is also connected to the conductors, bridging thereacross and the conductors' open end of the housing is filled with a resin 13. An outermost end of the switch 18 has an O-ring 22 fitted thereabout, a nut 25, and a switch-actuating plunger 24 projects from an outermost end of the switch 18. The plunger 24 is biasingly extensible from the switch (by spring means not shown), to cause switch actuation. As shown, the plunger 24 is in its retracted disposition, being held thus by a plug 26 occupying the outermost end of the housing 12.

The device 10, of singularly slim construction, is to be set within the stator of an electric motor (not shown) to detect an intrusion of water or a watery fluid. The conductors 14 and 16, are to be connected to means (not shown) for disconnecting the motor from its electrical power and/or to an alarm device.

Switch 18 can be in either an open or a closed attitude, with the plunger 24 in the retracted disposition shown, and changed to the alternative attitude with the plunger 24 extended. However, as noted, the plug 26 holds the plunger 24 in its retracted disposition against its biasing means.

Plug 26 is formed of an admixture of a first, water-soluble constituent, namely a powder of a modified starch, such as carboxmethyl starch (CMS), and a second, non-water-soluble constituent 23, namely a thermosetting resin, according to this embodiment of the invention. The resin defines a structure of internal bindings in the plug 26. However, upon water or a watery fluid encountering the plug 26, the starch powder expands and proceeds to destroy the resin-defined structure therein. Consequently, the water or fluid interfacing surface of the plug 26 weakens and the intrusive water or fluid can enter further into the plug 26.

As the current which needs to be interrupted by the device 10 may be strong, it is very important that the switching be instantaneous to avoid electric arcing. To this end, the plug 26 is so formed that the innermost surface thereof, which is engaged by the plunger 24, and the peripheral surface thereof which sealingly engages the inner surface of the housing 12 are more resistant to water dissolution than the inner body of the plug 26. Consequently, the plug 26 keeps sealing against water intrusion into the housing 12, all the while that water is dissolving the outermost and central portions one the plug 26, until there finally occurs so much dissolution that, finally, the plunger 24 breaks through the interfacing plug surface and actuates the switch 18. In this way, the switch 18 is shielded from any steadily entering moisture, and the electric arcing is avoided.

The admixture of the plug 26, i.e., the quantity of starch to resin, can be chosen to define a correct time for rupture of the plug to occur. Too, of course, such timing can be predetermined by the depth of the plug 26 within the housing 12.

The invention comprehends the formation of the plug 26 in the housing, i.e., molding the plug 26 directly in the housing 12. In so doing, it is insured that the aforesaid innermost surface and peripheral surface of the plug 26 will be formed with a more water-resistant film thereon, as more of the resinous binding material will establish itself thereat. After mold-forming the plug 26 in the housing 12, a portion of the end of the housing 12, and the outermost end of the plug 26 therewithin, are ground off, or cut off, (a) to obtain the optimum depth of plug 26 within the housing 12 to insure the correct switch-actuation timing, and (b) to remove the more water-resistant film of resinous binding material from the outermost, exposed end of the plug 26.

After the plug 26 has been mold-formed in the end of the housing 12, then to construct the remainder of the device 10, it remains only to enter the plunger-actuated switch 18, with the conductors 14 and 16 (and resistor 20) into the housing 12, toward the plug 26, until the plunger 24 is adequately retracted, and held thus, by the plug 26.

While I have described my invention in connection with a specific embodiment thereof, and prescribed steps of forming the same, it is to be clearly understood that this is done only by way of example and not as a limitation to the scope of the invention, as set forth in the objects thereof and in the appended claims.

We claim:

1. A moisture-detecting, switching device, comprising:

a dual-ended housing having an inner surface; and an electrical switch confined in a tight fit manner within said housing; wherein said switch has an actuating plunger (a) biasingly extensible therefrom, and (b) disposed in adjacency to one end of said housing; and means fluid-sealing off said one end of said housing and restraining said plunger against extension; wherein said sealing means comprises a material formed of an admixture of a first, water-soluble constituent, and a second, non-water-soluble constituent; and said second constituent defines a structure within said sealing means which is readily frangible.

2. A moisture-detecting, switching device, according to claim 1, wherein:

said sealing means comprises a plug;

said plug has an innermost surface which is engaged with said plunger, an outermost surface which opens onto said one end of said housing, and a peripheral surface which sealingly engages said inner surface of said housing; and said innermost and peripheral surfaces have a water-resistant film thereon comprising a thermosetting resin.

3. A moisture-detecting, switching device, according to claim 2, wherein:

said outermost surface of said plug is readily water-soluble.

4. A moisture-detecting, switching device, according to claim 1, wherein:

said first constituent comprises a substance which expands when wetted.

5. A moisture-detecting, switching device, according to claim 1, wherein:

said second constituent comprises a substance which, when wetted, (a) expands, and (b) destroys said structure.

6. A moisture-detecting, switching device, according to claim 1, wherein:

said first constituent comprises powdered starch, and said second constituent comprises a thermosetting resin.

7. A method of forming a moisture-detecting, switching device, comprising the steps of:

providing a dual-ended housing;

forming a sealing means, for fluid-sealing off one end of said housing, within said one end;

composing said sealing means of an admixture of a first, water-soluble constituent, and a second, non-water-soluble constituent which forms a readily-frangible structure within said sealing means;

confining within said housing a switch which has a biasingly extensible, actuating plunger; and setting said switch against said sealing means so that said plunger is retractably held against extension by said sealing means.

8. A method of forming a moisture-detecting, switching device, according to claim 7, further including the step of:

removing a portion of said one end of said housing and, therewith, an outermost portion of said sealing means.

9. A moisture-detecting, switching device, comprising:

a dual-ended housing having an inner surface; and an electrical switch confined in a tight fit manner within said housing; wherein said switch has an actuating plunger (a) biasingly extensible therefrom, and (b) disposed in adjacency to one end of said housing; and means fluid-sealing off said one end of said housing and restraining said plunger against extension; wherein said sealing means comprises a material formed of an admixture of a first, water-soluble constituent, and a second constituent which defines a structure within said sealing means which is readily frangible.

10. A method of forming a moisture-detecting, switching device, comprising the steps of:

providing a dual-ended housing;

forming a sealing means, for fluid-sealing off one end of said housing, within said one end;

composing said sealing means of an admixture of a first, water-soluble constituent, and a second constituent which forms a readily-frangible structure within said sealing means;

confining within said housing in a tight fit manner a switch which has a biasingly extensible, actuating plunger; and setting said switch against said sealing means so that said plunger is retractably held against extension by said sealing means.

* * * * *